US005551634A

United States Patent [19]

Raab et al.

[11] Patent Number: 5,551,634

[45] Date of Patent: Sep. 3, 1996

[54] FUEL INJECTION NOZZLE FOR AN INTERNAL COMBUSTION ENGINE

[75] Inventors: Alois Raab, Aalen; Klaus Binder, Deizisau; Ulrich Augustin, Kernen, all of Germany

[73] Assignee: Mercedes-Benz A.G., Stuttgart, Germany

[21] Appl. No.: 342,606

[22] Filed: Nov. 21, 1994

[30] Foreign Application Priority Data

Nov. 26, 1993 [DE] Germany ..... 43 40 305.0

[51] Int. Cl.[6] ..... F02M 41/16

[52] U.S. Cl. ..... 239/96; 239/124; 239/533.3

[58] Field of Search ..... 239/96, 533.3, 239/533.8, 533.12, 124

[56] References Cited

U.S. PATENT DOCUMENTS

| | | | |
|---|---|---|---|
| 1,755,192 | 4/1930 | Scott | 239/533.12 |
| 2,982,277 | 5/1961 | May et al. | 239/533.12 |
| 5,335,861 | 8/1994 | Matusaka | 239/533.8 |
| 5,464,156 | 11/1995 | Ricco et al. | 239/124 |

FOREIGN PATENT DOCUMENTS

| | | |
|---|---|---|
| 1277220 | 6/1972 | Brazil . |
| 1488985 | 10/1977 | Brazil . |
| 2028442 | 12/1971 | Germany . |
| 3227742 | 5/1983 | Germany . |
| 3928912 | 4/1990 | Germany . |
| 3906205 | 8/1990 | Germany . |
| 4115477 | 11/1991 | Germany . |

*Primary Examiner*—Andres Kashnikow
*Assistant Examiner*—Lisa Douglas
*Attorney, Agent, or Firm*—Klaus J. Bach

[57] ABSTRACT

In a fuel injection nozzle for an internal combustion engine with a fuel injection opening including a nozzle opening control needle with a body portion with discharge openings whose size depends on the axial displacement of the nozzle opening control needle and with means for limiting the axial displacement of the nozzle opening control needle, a hollow nozzle needle is disposed around the stem of the nozzle opening control needle and forms at its end a fuel control valve seat for controlling fuel flow to the fuel injection opening and a control space is provided at the end of the hollow nozzle needle opposite its valve seat which is in communication with a pressurized fuel supply for holding the hollow nozzle needle in a seated position but from which the pressure can be released to permit lifting of the hollow nozzle needle by pressurized fuel supplied to the seating area end of the hollow nozzle needle whereupon the pressurized fuel released through the fuel control valve displaces the nozzle opening control needle to open the discharge opening as permitted by limiting mechanism.

6 Claims, 2 Drawing Sheets

FUEL INJECTION NOZZLE FOR AN INTERNAL COMBUSTION ENGINE

BACKGROUND OF THE INVENTION

The invention relates to a fuel injection nozzle for an internal combustion engine which includes means for adjusting the injection openings.

A fuel injection nozzle is known from the German Offenlegungsschrift 20 28 442 in which fuel at high pressure reaches a nozzle space and a pressure space provided at the nozzle needle end facing away from the injection end. As soon as the pressure space is connected to a relief conduit by a piezoelectrically operated control valve, the high pressure in the pressure space collapses and the nozzle needle lifts from its valve seat.

It is the object of the present invention to provide a fuel injection nozzle which permits variable shaping of the injection pressure curve.

SUMMARY OF THE INVENTION

In a fuel injection nozzle for an internal combustion engine with a fuel injection opening including a nozzle opening control needle with a body portion with discharge openings whose size depends on the axial displacement of the nozzle opening control needle and with means for limiting the axial displacement of the nozzle opening control needle, a hollow nozzle needle is disposed around the stem of the nozzle opening control needle and forms at its end a fuel control valve seat for controlling fuel flow to the fuel injection opening and a control space is provided at the end of the hollow nozzle needle opposite its valve seat which is in communication with a pressurized fuel supply for holding the hollow nozzle needle in a seated position but from which the pressure can be released to permit lifting of the hollow nozzle needle by pressurized fuel supplied to the seating area end of the hollow nozzle needle whereupon the pressurized fuel released through the fuel control valve displaces the nozzle opening control needle to open the discharge opening as permitted by limiting means.

In the arrangement according to the invention, the high-pressure passage extending to the nozzle space of the nozzle needle is interrupted by the hollow needle valve during the injection pause. It is only when pressure is relieved from the control space that the hollow needle frees the high-pressure connection to the nozzle space and effects opening of the nozzle needle in a controlled manner.

A particular control of the injection cross-section and therefore of the injection quantity can be realized by the provision of a slotted nozzle opening towards the outside because the slot nozzle opening cross-section at the combustion space end can be controlled by specific pressure relief on the back of the nozzle needle by means of a control valve or by mechanical means which limit the lift of the nozzle needle in a manner which can be steplessly adjusted. In this way, it is also possible to control the nozzle needle lift and the injection cross-section in accordance with a characteristic diagram.

The invention is represented in the drawing and is described in greater detail below on the basis of exemplary embodiments.

DESCRIPTION OF PREFERRED EMBODIMENTS

Figure 1:
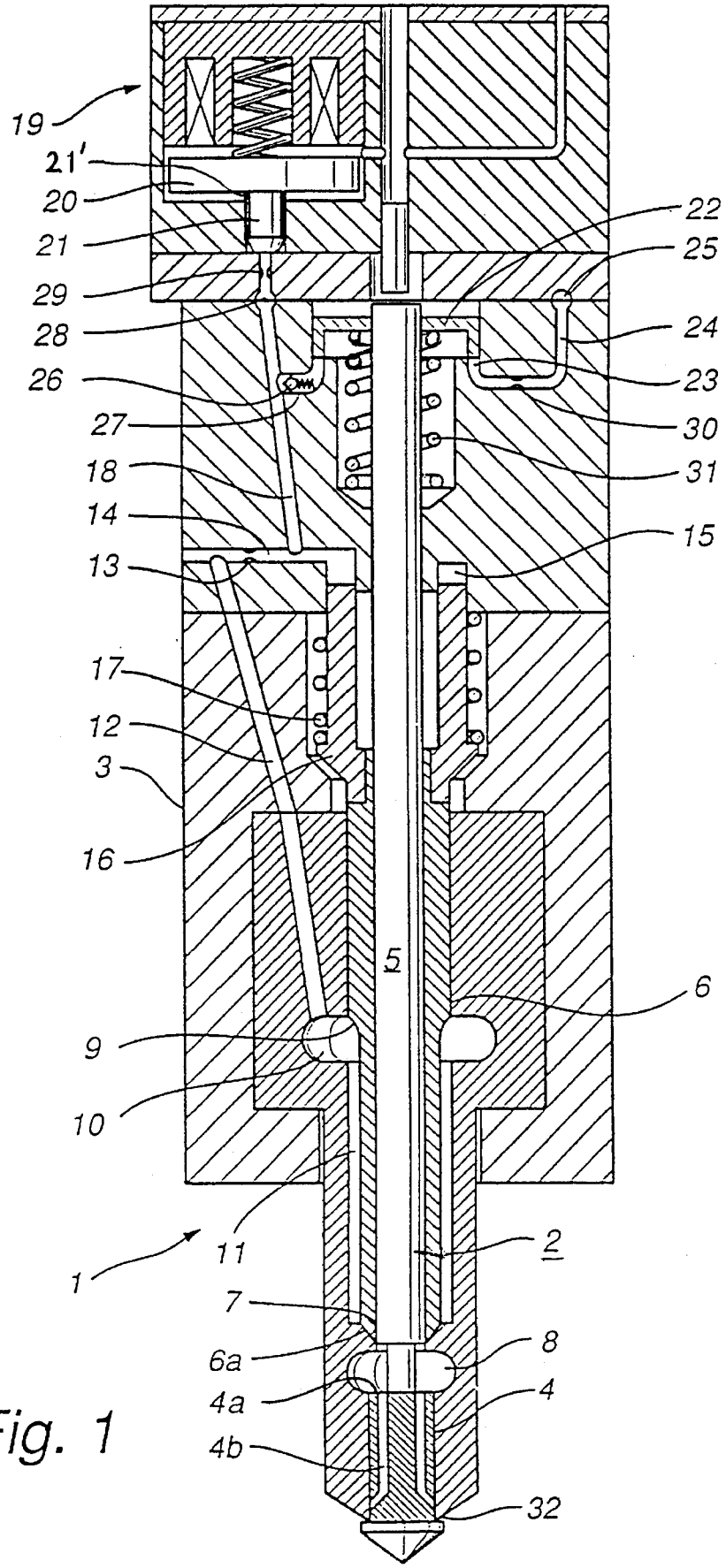
FIG. 1 shows a fuel injection nozzle according to the invention with hydraulic control of the nozzle needle lift.

A fuel injection nozzle 1 with variable injection cross-sections is configured as a slot nozzle with a nozzle needle 2 opening towards the outside, the tip of the nozzle needle 2 consisting of a slotted body 4 guided in the nozzle body 3. The needle stem 5 of the nozzle needle 2, which stem is smaller in diameter than the slotted body 4, is surrounded by a hollow needle 6 whose conical seating surface *6a* is disposed on a conical seat 7 of the nozzle body 3. A nozzle space 8, which is bounded by a pressure shoulder *4a* of the slotted body 4 and which is continually in communication with all the slots *4b* in the slotted body 4, is located below the conical seat 7.

Approximately in the center of its length, the hollow needle 6 has a pressure shoulder 9 surrounded by a pressure space 10 and an annular space 11 extending from the pressure shoulder 9 and reaching all the way to the conical seat 7. A fuel supply passage 12 connected to a high-pressure pump via a common supply conduit (common rail) for all the fuel injection nozzles (not shown) of an engine opens into the pressure space 10 and an inlet passage 14 provided with a throttle 13 branches off from the fuel supply passage 12 and leads to an annular control space 15 located on the backside of the hollow needle 6. This annular control space 15 is bounded by the annular end surface of the hollow needle 6.

The effective pressure area on the backside of the hollow needle 6 is larger than the pressure area of the shoulder 9. The hollow needle is therefore held seated on the conical seat 7 by the high pressure of the fuel supplied to the nozzle.

The hollow needle 6 comprises two parts of which the widened part at the end opposite the injection end surrounds the nozzle needle 2 in spaced relationship therefrom and has a support 16 for a return spring 17 which biases the hollow needle 6 to its seated position.

A control passage 18, which branches off from the inlet passage 14 downstream of the throttle 13, leads to a control valve which is configured as a magnetic valve 19 with a disc-shaped magnet armature 20 and a magnet armature stem 21 provided with fuel flow grooves 21'.

A cup-shaped pressure piece 22, as shown in FIG. 1, is firmly connected to the rear end of the nozzle needle stem 5 and bounds an annular space 23 located underneath it. This annular space 23 is connected to the control passage 18 via a connecting passage 24 and a ring conduit, and via a supply passage 27 with a non-return valve 26. The control passage 18 contains a throttle 29 between its jointure 28 with the ring conduit 25 and the magnet armature stem 21. A further throttle 30 is provided in the connecting passage 24.

A spring 31, which is supported at one end on the pressure piece 22 and at the opposite end on the housing, biases the nozzle needle 2 onto its valve seat 32.

Figure 2:
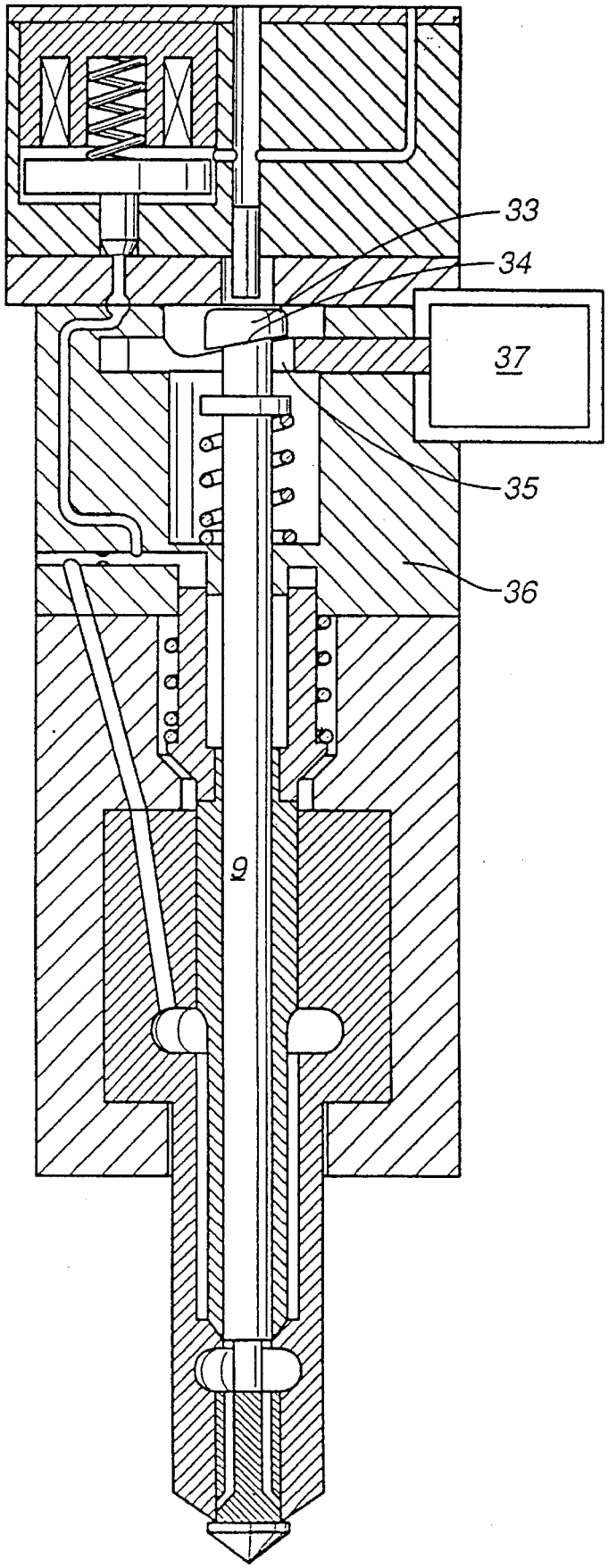
FIG. 2 shows the fuel injection nozzle with mechanical control of the nozzle needle lift.

A mechanical system for influencing the nozzle needle lift is shown in FIG. 2 as an alternative to the hydraulic means for controlling the nozzle needle lift shown in FIG. 1 and, therefore, the fuel injection opening cross-section.

On its back, the nozzle needle 2 is provided with a widened head part 33 with a cam surface 34, which extends transverse to the needle axis and which interacts with a wedge-shaped sliding piece 35 surrounding the needle stem 5 for controlling the needle lift. The sliding piece 35 is guided transverse to the needle axis in a housing part 36 of the injection nozzle 1 and is connected to an actuator 37 which can be activated as a function of operating parameters.

Operation of the Fuel Injection Nozzle

In the position shown in FIG. 1, the fuel injection nozzle 1 is closed, the magnetic valve 19 is not energized and the high fuel supply pressure is effective, via the inlet conduit 14 including throttle 13 on the back of the hollow needle 6 and, simultaneously, in the pressure space 10, on the smaller area of the pressure shoulder 9 of the hollow needle 6.

The hollow needle 6 is held on its conical seat 7 and prevents the supply of high pressure fuel to the nozzle space 8.

The high pressure also acts, via the non-return valve 26, on an annular surface of the cup-shaped pressure piece 22 which biases the nozzle needle 2 onto its valve seat 32.

Upon energization of the magnetic valve 19, the backside of the hollow needle 6 is relieved due to a larger passage cross-section of the throttle 29 relative to that of the throttle 13. The high fuel pressure is now only effective on the pressure shoulder 9 of the hollow needle 6 which thereupon is lifted off the seating surface **6*a* and provides for high-pressure communication with the nozzle space 8. The nozzle needle 2 opens because of the action of the fuel pressure but the nozzle needle lift, that is, the effective injection cross-section, is controlled by the forces acting on the pressure piece 22, the movement of which is hydraulically controlled and dampened. During opening of the needle, the pressure piece 22 displaces a defined volume in the annular space 23; this volume is released via the throttle 30 whereby the opening of the needle is delayed in a defined manner. By this means, the effective injection cross-section is opened as a function of the duration of energization of the magnetic valve 19**, i.e., as a function of the quantity of the fuel injected.

In the case of a short duration of energization of the magnetic valve 19, and therefore of a small injection quantity, a smaller injection cross-section is provided with a partially opened control nozzle needle 2 but in the case of a longer energization duration, and therefore a larger injection quantity, the needle 2 is fully extended so that the maximum injection cross-section is provided.

With the needle lift control as shown in FIG. 2, the lift of the nozzle needle can be steplessly adjusted, the lift being limited by the wedge-shaped sliding piece 35 interacting with the nozzle needle 2. This sliding piece 35 is connected to the actuator 37. The activation can take place piezoelectrically, magnetostrictively or mechanically—directly or indirectly. The nozzle needle lift and the injection cross-section can therefore be controlled also in this way.

What is claimed is:

1. A fuel injection nozzle for an internal combustion engine comprising: a nozzle housing having an opening with a valve seat at one end thereof, a nozzle opening control needle disposed in said opening and being normally seated on said valve seat, said nozzle opening control needle having a body portion with axially elongated fuel discharge openings with an effective opening depending on the axial outward displacement of said nozzle opening control needle from said valve seat and a needle stem including means for holding said nozzle opening control needle in its seated position and for limiting outward displacement thereof, a hollow nozzle needle disposed around said needle stem and forming a fuel control valve having a seating surface normally seated on a fuel control valve seat disposed in axially spaced relationship from said nozzle opening control needle body portion with a nozzle space formed between said nozzle opening control needle body portion and said fuel control valve seat, said hollow nozzle needle having, at its end opposite its seating surface, a control space, and passages in said nozzle housing for supplying fuel to said control space and to said fuel control valve, said hollow nozzle needle having a shoulder area exposed to the pressurized fuel supplied to said control valve to provide a valve lifting force thereto and means for timed release of the fuel pressure in said control space to permit lifting of said hollow nozzle needle thereby permitting pressurized fuel to enter said nozzle space and to unseat said nozzle exposing control needle for outward displacement of said body portion as limited by said limiting means for controlling the effective fuel discharge opening.

2. A fuel injection nozzle according to claim 1, wherein said hollow needle valve shoulder area is surrounded by a pressure space to which said fuel supply passages are connected and the fuel supply passage leading to said control space includes a throttle to limit fuel flow thereto and a pressure control passage extends from the area of said fuel supply passage between said control space and said throttle to a control valve adapted to be operated for timed relief of the pressure in said control space to permit lifting of said hollow needle valve by the pressurized fuel in said pressure space.

3. A fuel injection nozzle according to claim 2, wherein said control valve is a magnetic valve having an armature for controlling the pressure relief through said pressure control passage, said pressure control passage including a throttle with a flow cross-section larger than that in the fuel supply passage leading to said control space.

4. A fuel injection nozzle according to claim 3, wherein said means for limiting the outward displacement of said nozzle opening control needle includes a cup-shaped pressure piece bounding an annular pressure space which is in communication with said relief passage by way of a throttled connecting passage and a ring conduit and also by way of a supply passage including a non-return valve preventing back flow of pressurized fluid from said annular space to said control passage is when the pressure in said pressure control passage is relieved by said magnetic valve.

5. A fuel injection nozzle according to claim 1, wherein the outward displacement of said nozzle opening control needle is dependent on the amount of fuel injected thereby providing for an injection nozzle opening cross-section corresponding to the amount of fuel injected.

6. A fuel injection nozzle according to claim 5, wherein said means for limiting the outward displacement of said nozzle opening control needle includes a head piece at the end of said control nozzle needle opposite its seat and a wedge-shaped sliding body movable by an actuator relative to said head piece for limiting movement of said head piece.

* * * * *